US006215251B1

(12) United States Patent
Orchard-Webb

(10) Patent No.: US 6,215,251 B1
(45) Date of Patent: Apr. 10, 2001

(54) SPARK GAP FOR HIGH VOLTAGE INTEGRATED CIRCUIT ELECTROSTATIC DISCHARGE PROTECTION

(75) Inventor: Jonathan Harry Orchard-Webb, Wales (GB)

(73) Assignee: Mitel Corporation (CA)

( * ) Notice: Subject to any disclaimer, the term of this patent is extended or adjusted under 35 U.S.C. 154(b) by 0 days.

(21) Appl. No.: 09/246,839

(22) Filed: Feb. 9, 1999

(30) Foreign Application Priority Data

Feb. 21, 1998 (DE) ..... 9803581

(51) Int. Cl.[7] ..... H05B 37/02
(52) U.S. Cl. ..... 315/209 M; 357/2
(58) Field of Search ..... 361/220, 56; 257/355; 437/40; 357/2; 324/158; 315/209 M; 313/632; 102/202.4, 202.5, 202.7

(56) References Cited

U.S. PATENT DOCUMENTS 4,809,044 * 2/1989 Pryor et al. ..... 357/2
5,357,397 * 10/1994 Leary ..... 361/220
5,436,183 * 7/1995 Davis et al. ..... 437/40
5,440,162 * 8/1995 Worley et al. ..... 257/355
5,610,790 * 3/1997 Staab et al. ..... 361/56
5,629,617 * 5/1997 Uhling et al. ..... 324/158.1
5,811,935 * 9/1998 Pinker et al. ..... 313/632
5,992,326 * 11/1999 Martinez-Tovar et al. ..... 102/202.4

FOREIGN PATENT DOCUMENTS 790758 8/1997 (EP) .
2049299 12/1980 (GB) .

* cited by examiner

*Primary Examiner*—Don Wong
*Assistant Examiner*—Chuc Tran D
(74) *Attorney, Agent, or Firm*—Laubscher & Laubscher

(57) ABSTRACT

A spark gap assembly having electrodes spaced from bonding pads and the integrated circuit. The electrodes contact a plurality of resistors to reduce voltages and dissipate energy experienced during electrostatic discharge (ESD) which would otherwise damage the integrated circuit.

8 Claims, 2 Drawing Sheets

SPARK GAP FOR HIGH VOLTAGE INTEGRATED CIRCUIT ELECTROSTATIC DISCHARGE PROTECTION

FIELD OF THE INVENTION

The present invention relates to a spark gap for high voltage integrated circuit electrostatic discharge protection circuit and more particularly, the present invention relates to a spark gap in a plastic assembly capable of withstanding high voltage and dissipating same.

BACKGROUND OF THE INVENTION

Over the years, since the invention of integrated circuits, an increasing number of high voltage circuit functions have been integrated into the silicon integrated circuit. Prior to this the high voltage circuit functions were implemented with discrete components or designed into hybrid modules. These two technologies are expensive for a given circuit compared to an integrated circuit.

The present invention provides an alternative to existing arrangements capable of isolating delicate components in the circuit from static discharge damage which may be of the order of kilovolts.

An important feature for implementing high voltage functionality on a semiconductor integrated circuit is to isolate the core circuitry behind high value resistors, usually of poly silicon resistors. Unfortunately, a problem arises when the chip is subjected to electrostatic discharges, ESD, because the resistance offered by the resistors is much higher than the output resistance of the ESD discharge. This causes a significant voltage to appear on the integrated circuit. Since ESD voltages are typically a few kilovolts, damage to the field oxide of the circuit may result. A particularly difficult problem arises when an input pad has to support both positive and negative high voltages in normal operation. Under these conditions, it is unlikely that a suitable on-chip diode pair can hold off the operating voltages and protect the semiconductor chip from ESD damage.

In principle, a simple spark gap may be used to provide protection for either polarity pulse and also to hold off the circuit voltages. A spark gap can be made to operate at less than 1000V on an integrated circuit, which may be adequate to protect the field oxide.

However, a further complication arises from the commercial need to use inexpensive plastic encapsulation for the silicon chip.

The present invention thus provides a spark gap operable in a plastic package, and a protection device for operation at about 2 kV ESD voltage (human body model, HBM).

SUMMARY OF THE INVENTION

One object of the present invention is to provide an improved spark gap assembly which overcomes the limitations of the prior art.

A further object of one embodiment of the present invention is to provide a spark gap assembly, comprising:

a first electroconductive bonding pad having an electrode;

a second electroconductive bonding pad having an electrode, each electrode of each pad in spaced relation to the other electrode;

at least a further electroconductive material overlying and isolating the first bonding pad and electrode and the second bonding pad and electrode; and a spark gap in the further material between isolated pads and electrodes.

Yet another object of one embodiment of the present invention is to provide a spark gap assembly, comprising:

an electroconductive bonding pad having an electrode, the pad including a layer of first electroconductive material thereover;

a layer of second electroconductive material in electrical communication with the electrode;

at least one spark gap in the layer of second material; and a plurality of individual resistor sections integral with the second material and adjacent the spark gap for reducing voltage in the gap from an electrostatic discharge.

Having thus generally described the invention, reference will now be made to the accompanying drawings illustrating preferred embodiments.

BRIEF DESCRIPTION OF THE DRAWINGS

Similar numerals employed in the text denote similar elements.

DETAILED DESCRIPTION OF THE PREFERRED EMBODIMENTS

Figure 1:
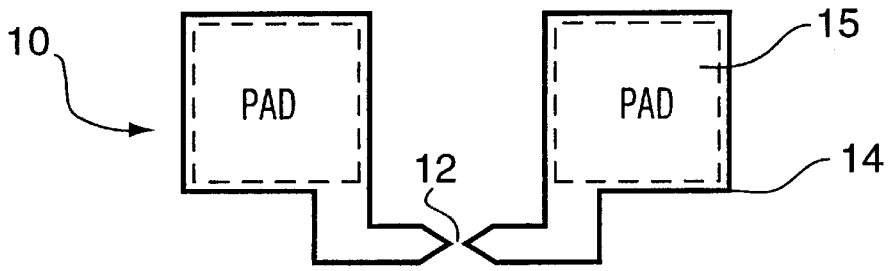
FIG. 1 PRIOR ART
FIG. 1 is a schematic representation of a prior art spark gap.

FIG. 1 illustrates a prior art spark gap arrangement, generally denoted by numeral 10 with the spark gap denoted by numeral 12, electrode 14 and bonding pads 15. Such arrangements have not proved to be successful for ESD protection on integrated circuits for a number of reasons. First, the breakdown voltage for such arrangements is too high. Second, the aluminum metal commonly used in the electrodes 14 tends to melt forming an open circuit or conductive paths on the integrated circuit subsequent to an ESD discharge.

Furthermore, submicron processes are now reaching dimensions where it may be possible for the electric field to pull atoms apart without the need for impact ionization (avalanche). This may lead to low voltage spark gaps.

Figure 2:
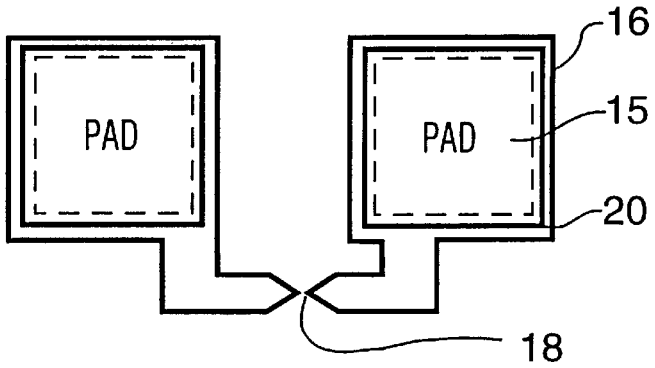
FIG. 2 is a schematic representation of a spark gap employing poly silicon.

In respect of the use of the metal in the spark gap, plastic is more desirable considering that the use of poly silicon for the spark gap greatly reduces melting and shorting as opposed to the commonly used aluminum or aluminum alloys, as employed in the example of FIG. 1. The embodiment shown in FIG. 2 provides a poly silicon layer 16 with a spark gap with isolated electrodes 20 spaced from the gap 18. The poly silicon layer is placed under the bond pad to avoid special contacts to poly silicon. It has been further discovered that by enlarging the active part of the spark gap by using square ends, the heat is dissipated over a larger area, a significantly reduced rise in temperature is realized thus improving the spark gap power handling performance. The embodiment of FIG. 2 combines the larger area and the poly silicon material.

Figure 3:
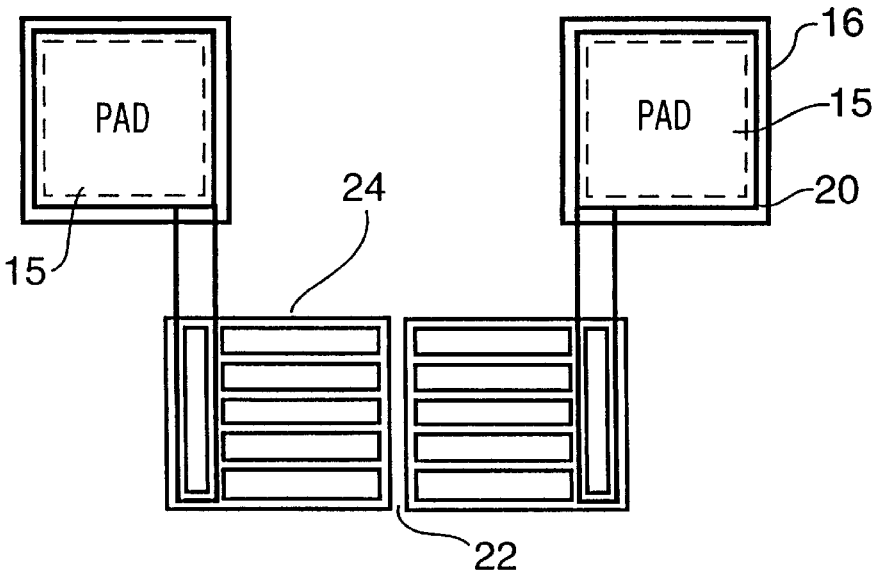
FIG. 3 is a schematic representation of a spark gap according to one embodiment of the present invention.

Referring now to FIG. 3, shown is a further embodiment of the present invention. By incorporating a distributed poly silicon resistance in the form of a plurality of integral resistor sections 24 adjacent the active part of the spark gap, denoted by numeral 22 in this example, three advantages have been realized, namely: the dissipation is spread more uniformly over the spark gap and in the poly silicon resistor; there is a reduction in the power dissipated in the spark gap; and the resistor separates and isolates the heat sensitive aluminum to poly silicon contact on the bond pad from the very hot part of the spark gap to thus alleviate conductive path formation, etc.

It has been found that if poly silicon is used on the bonding pads 15, the device is more robust.

The most difficult problem is to find a means of getting spark gap action in a plastic package.

Experimental results indicate that certain configurations of spark gaps appear to generate sufficient local stress in plastic to poly silicon interface to produce enough delamination for a spark to be generated. The energy that can be dissipated without causing a high leakage current is, however, much lower than that for an open air gap.

To compensate for the relatively poor energy dissipation performance, the use of ballast resistors becomes very important.

Figure 4:
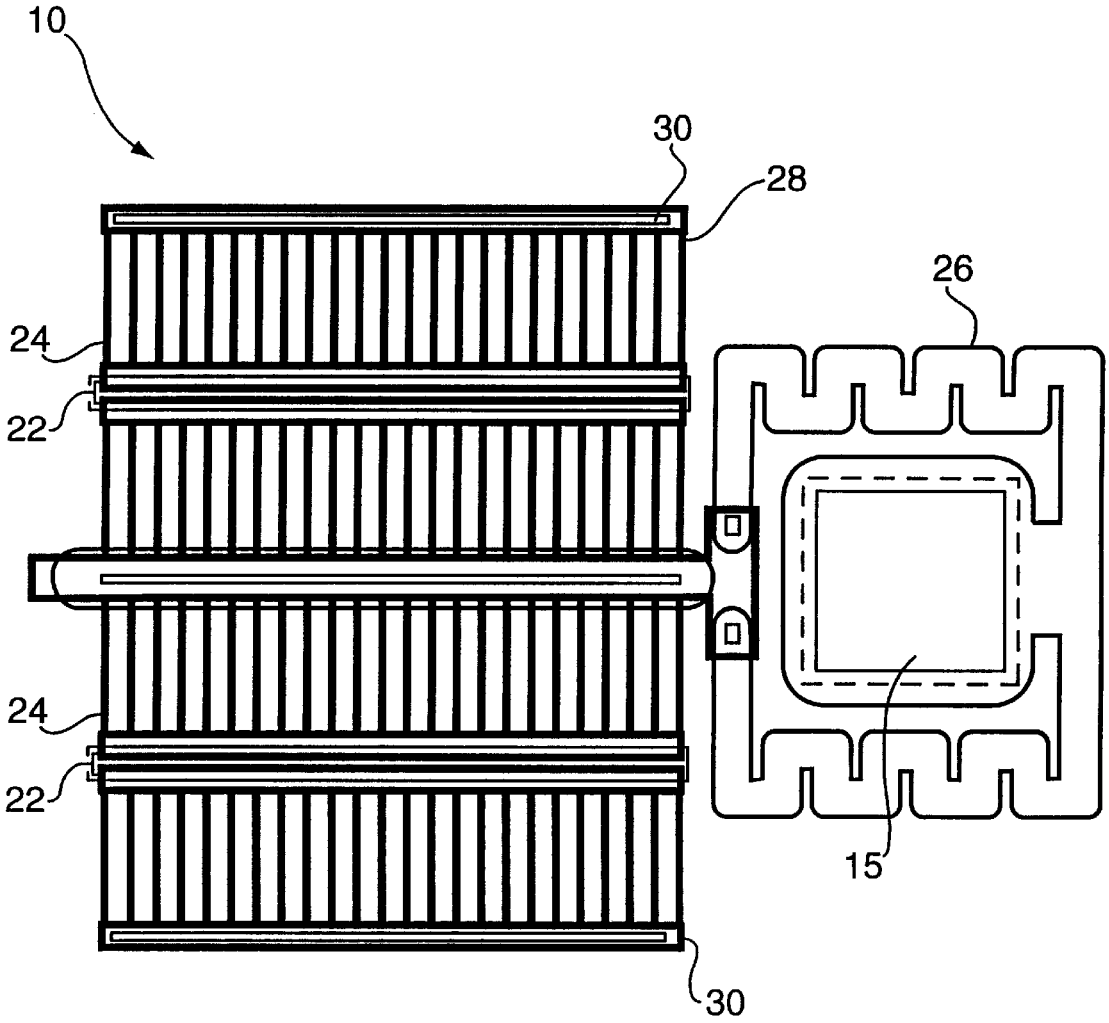
FIG. 4 is a schematic representation of a spark gap according to a further embodiment of the present invention.

FIG. 4, by way of example, shows a practical spark gap incorporating two spark gaps designed with a plurality of poly silicon resistors. The arrangement shown is for a process with a field oxide breakdown voltage from the poly silicon resistor 26 of 1,000V. The poly silicon sheet resistance is 20 ohms/square. The arrangement includes a second poly silicon layer 28 having a resistance of 400 ohms/square. Unlike normal input protection, almost the full ESD energy has to be absorbed on the chip (not shown). However, series resistance does not have to be kept to a minimum and the resistors 24 are designed here to generate stress in the plastic/poly silicon interface, dissipate energy, drop voltage and separate the contact electrodes from the hot zone of the spark gap 22.

The arrangement and values of resistors depends on the electrical parameters of the process used for the integrated circuit. In this regard, FIG. 4 is an example tailored to a specific process. Other quite different arrangements may be used to take advantage of the techniques revealed herein and to accommodate different process details.

The system Illustrated includes two identical networks of resistors 24 in parallel and, for convenience, only one network will be described.

When an ESD occurs between the pad 15 and supply rail 30, the high voltage is held off by the poly resistor 26, which has a higher break down to the substrate than poly resistor 24. The poly resistor 26 leads via the first set of resistors 24 to the spark gap 22, which breaks down and the ESD current flows through the second poly resistor 24 to the supply rails 30. The voltage is divided across the three resistors, which absorb energy and limit the energy dissipated in the spark discharge. For this particular implementation, roughly half of the ESD voltage is dropped across the resistors, so that for a 2 kV ESD discharge, the output to the circuit resistor encounters less than 1 kV. The remote end of the high value input resistor is protected by a conventional protection diode (not shown).

The particular geometry of the resistors and spark gap are designed to promote mechanical stress during encapsulation due to differential thermal expansion between the resistor and the plastic so that a tiny cavity is formed at the spark gap.

As a variation, metal with a higher melting point than aluminum could be used instead of poly silicon.

The design of the poly silicon shape is empirical and could probably be improved on. However, the conventional geometries appear to be ineffective. Both the resistive part of the structure, which generates the mechanical stress and the bar ends appear to be important. Any layer of poly silicon or any conductive layer with a sufficiently high melting point could be used for the spark gap structure.

The ideas outlined in this application can be applied to any silicon integrated circuit that requires protection at a high voltage.

It can also be applied to any sort of integrated circuit, particularly as it uses only conductive layers that are common to any integrated circuit (e.g. MOS III/V e.g. gallium arsenic, silicon carbide, bipolar).

It is possible that the application may be found outside integrated circuits, where very finely defined spark gaps are needed. One such application might be an external protection system mounted on a multi chip module.

Micro mechanical integrated circuits is an emerging technology that is due to discover ESD damage. These tiny components will be very susceptible to ESD, but in many cases there will be no electronic circuitry to provide protection diodes. It would be simple and cost effective to integrate a lateral spark gap into these devices.

Arrays of spark gaps could be used for nuclear particle detectors, using the ionization to trigger the gap and give information on position, intensity and time.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A spark gap assembly in combination with an integrated circuit, comprising:

a first electroconductive bonding pad having an electrode;

a second electroconductive bonding pad having an electrode, each electrode of each pad in spaced relation to the other electrode;

at least a further electroconductive material overlying and isolating said first bonding pad and electrode and said second bonding pad and electrode; and a spark gap in said further material between isolated pads and electrodes, said further electroconductive material including a plurality of individual resistor sections integral with each isolated pad and electrode for controlling electrostatic energy in said spark gap.

2. The spark gap assembly as set forth in claim 1, wherein said further electroconductive material comprises at least one partially conductive layer of material.

3. The spark gap assembly as set forth in claim 2, wherein said further electroconductive material comprises a material having a melting point greater than aluminum.

4. The spark gap assembly as set forth in claim 2, wherein said material comprises poly silicon.

5. A spark gap assembly, comprising:

an electroconductive bonding pad having an electrode, said pad including a layer of first electroconductive material thereover;

a layer of second electroconductive material in electrical communication with said electrode;

at least one spark gap in said layer of second material; and a plurality of individual resistor sections integral with said second material and adjacent said spark gap for reducing voltage in said gap from an electrostatic discharge.

6. The spark gap assembly as set forth in claim 5, wherein said second material further includes means for connection to power rails.

7. The spark gap assembly as set forth in claim 5, wherein said layer of first material and said layer of second material each have a different resistance value.

8. The spark gap assembly as set forth in claim 5, wherein at least one of said first material and said second material comprises poly silicon.

* * * * *